United States Patent [19]

Kato et al.

[11] 4,317,784

[45] Mar. 2, 1982

[54] ADJUST SCREW DEVICE FOR CARBURETOR

[75] Inventors: Yuzo Kato, Toyota; Hidenori Tateno, Aichi; Mikitoshi Kako, Tokai, all of Japan

[73] Assignees: Toyota Jidosha Kogyo Kabushiki Kaisha, Toyota; Aisan Kogyo Kabushiki Kaisha, Ohfu, both of Japan

[21] Appl. No.: 213,578

[22] Filed: Dec. 5, 1980

[30] Foreign Application Priority Data

Dec. 29, 1979 [JP] Japan ..... 54-181957[U]

[51] Int. Cl.[3] ..... F02M 19/12

[52] U.S. Cl. ..... 261/65; 261/DIG. 84; 137/384

[58] Field of Search ..... 261/DIG. 84, 65, DIG. 38; 137/384

[56] References Cited

U.S. PATENT DOCUMENTS

| | | | |
|---|---|---|---|
| 3,414,244 | 12/1968 | Patterson, Jr. | 261/DIG. 38 |
| 4,239,710 | 12/1980 | Sato | 261/65 |

FOREIGN PATENT DOCUMENTS

| | | | |
|---|---|---|---|
| 2548226 | 5/1976 | Fed. Rep. of Germany | 261/DIG. 84 |
| 54-118923 | 8/1978 | Japan | 261/65 |
| 54-118924 | 9/1979 | Japan | 261/65 |
| 1236696 | 6/1971 | United Kingdom | 261/DIG. 38 |

*Primary Examiner*—Tim R. Miles

*Attorney, Agent, or Firm*—Finnegan, Henderson, Farabow, Garrett & Dunner

[57] ABSTRACT

An adjust screw device for use with a carburetor of an internal combustion engine having stops for restricting the range within which the automobile user can readjust the idle R.P.M. by adjusting the adjust screw at the carburetor. The adjust screw device is composed majorly of a first adjust screw having a large adjustable range and a second adjust screw for fine adjustment, the physical position of the second adjust screw being changed by the adjustment of the first adjust screw. After initial adjustment of the first adjust screw by the manufacturer, further adjustment of the screw is completely blocked and the second adjust screw is then adjustable by the user only over a predetermined range.

26 Claims, 8 Drawing Figures

ADJUST SCREW DEVICE FOR CARBURETOR

BACKGROUND OF THE INVENTION

1. Field of the Invention

The present invention relates to an adjust screw device for a carburetor of an internal combustion engine to be installed on an automobile or the like, and more particularly to an adjust screw device for a carburetor, by which the exhaust gas cleaning function intrinsically incorporated in the automobile or the like is ensured by limiting the range within which the automobile user can adjust an idle R.P.M. adjusting screw.

2. Description of the Prior Art

A carburetor has conventionally been equipped with an adjust screw partly for presetting the idle R.P.M. of an internal combustion engine and partly for adjusting the idle R.P.M. which has been changed due to the aging during the using process. This adjust screw is mounted, for example, on a stationary bracket which is positioned in the vicinity of the throttle lever of the carburetor, and has its leading end abutting against the throttle lever. A throttle lever shaft is fixed to the throttle lever at a position which is eccentric from the abutting position between the throttle lever and the leading end of the adjust screw. As a result, by rotating the adjust screw so that it moves toward or away from the throttle lever, the throttle lever is moved so that a throttle valve in the carburetor is rotated by the throttle lever shaft. In other words, the idle R.P.M. of an automotive engine can be preset at a desired value by rotating the adjust screw back and forth.

However, since the adjust screw has its head exposed to the outside, the user of the automobile, for example, can readjust the opening of the throttle valve freely up to an unnecessary range, and the exhaust gas cleaning function intrinsically incorporated in the automobile may resultantly be deteriorated to a considerable extent by that readjustment.

OBJECTS OF THE INVENTION

It is therefore an object of the present invention to provide an adjust screw device for a carburetor which can prevent the alteration and mistaken adjustment by the user of an automobile without fail.

Another object of the present invention is to provide an adjust screw device for a carburetor, which can retain the exhaust gas cleaning function intrinsically incorporated in the automobile.

Still another object of the present invention is to provide an adjust screw device for a carburetor, which allows the user to adjust the opening of a throttle valve only within a predetermined range in case the opening of the throttle valve is changed due to the aging as the use of the automobile proceeds.

A further object of the present invention is to provide a simplified adjust screw device for a carburetor which allows the initial adjustment of the idle R.P.M. to be remarkably easily performed by the manufacturer.

Other and further objects, features and advantages of the present invention will appear more fully from the following description.

BRIEF EXPLANATION OF THE DRAWINGS

FIG. 6(*b*) is a side view showing a lock key; and

FIG. 6(*c*) is a top plan view showing the lock key.

DETAILED DESCRIPTION OF THE INVENTION

Figure 1:
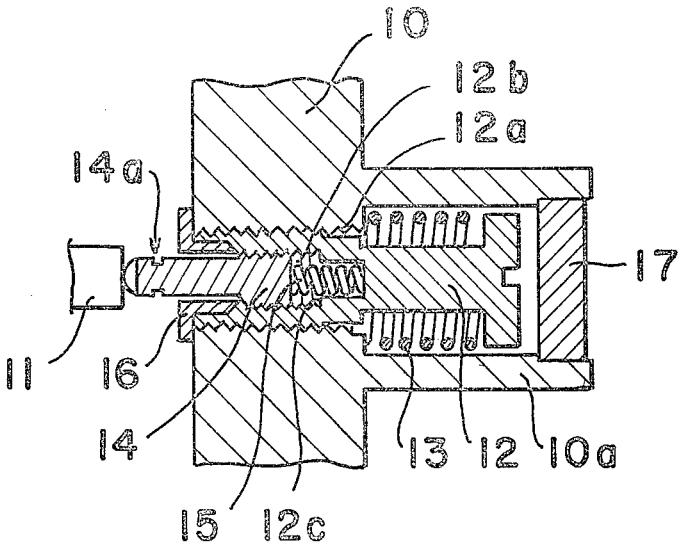
FIG. 1 is a sectional view showing the essential portion of a first embodiment of the present invention.
Figure 2:
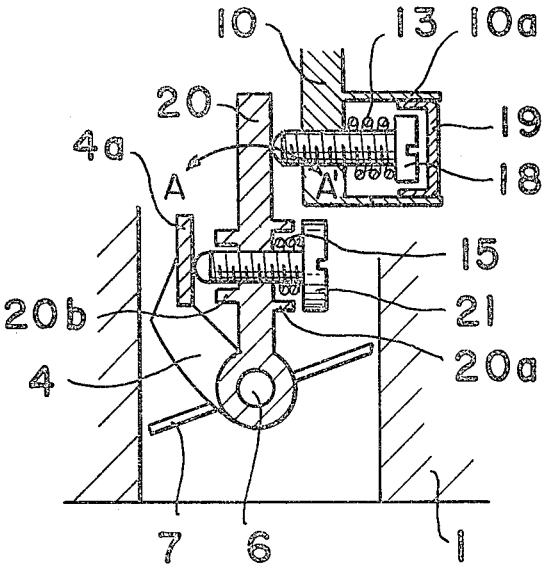
FIG. 2 is a sectional view showing the essential portion of a second embodiment of the present invention.

FIG. 1 shows a first embodiment of the present invention. Indicated at reference numeral 10 is a stationary bracket which is attached to a carburetor (FIG. 2). This stationary bracket 10 is arranged in the vicinity of the abutment portion 11 of a throttle lever, and a first adjust screw 12 having a large adjusting range is screwed into the stationary bracket 10 such that it can move toward and away from the abutment portion 11. The stationary bracket 10 is formed with a protruding cylindrical portion 10*a*, which surrounds the head and adjacent portion of the first adjust screw 12, so that this head and adjacent portion are disposed within that cylindrical portion 10*a*. Numeral 13 indicates a compression coil spring which is interposed between the stationary bracket 10 and the head of the first adjust screw 12.

In the first adjust screw 12 thus constructed, there is screwed concentrically a second adjust screw 14 for fine adjustment, which can be moved back and forth in the axial direction of the first adjust screw 12 when the second screw is rotated. The bore 12(*b*) into which the second adjust screw 14 is rotatably fitted has a predetermined depth and a shoulder 12*c* therein for limiting the adjustment of the second screw with respect to the first screw 12.

More specifically, the second adjust screw 14 is screwed into and supported by the first adjust screw 12 so that it is moved back and forth the same distance simultaneously with the backward and forward movements of the first adjust screw 12. On the other hand, the second adjust screw 14 has its outer end adjacent the abutment portion 11, formed with an annular groove 14*a* so that rotation of the second adjust screw 14 only can be effected by bringing a not-shown special tool into engagement with that annular groove 14*a*.

Numeral 16 indicates a stop bush for the adjust screw 14, which stop bush is mounted for preventing the second adjust screw 14 from coming out. More specifically, the stop bush 16 is fitted into an unthreaded portion of a threaded bore 12*a* in which the first adjust screw 12 is rotatably positioned and has its end face sitting on the outer wall of the stationary bracket 10. Moreover, numeral 17 indicates a sealing plug, which is fitted in the cylindrical portion 10*a* of the stationary bracket 10 for blocking access to the head of the first adjust screw 12 so that the adjustment of the first adjust screw from the outside is made impossible.

The adjust screw device for the carburetor thus constructed according to the first embodiment of the present invention is adjusted at the engine adjusting step of the automobile manufacturer, for example, as follows. First of all, the second adjust screw 14 is preadjusted to have such an adjusting allowance that the R.P.M. of a (not-shown) engine can be changed within a relatively small R.P.M. range, for example, from 150 R.P.M. to 200 R.P.M. when the second adjust screw 14 is rotated until it abuts against the first adjust screw 12. Then, this first adjust screw 12 is rotated to perform such an adjustment as can attain the throttle opening which effects the idle R.P.M. preset by the manufacturer. After that, the sealing plug 17 is fitted into the cylindrical portion 10*a* of the stationary bracket 10 thereby to seal up the first adjust screw 12.

The R.P.M. of the engine, which is predetermined by the first adjust screw 12, is changed, while time elapses, due to the continuous use after the production or due to the deteriorations in the respective parts of the engine. In case this change takes place, the user or the like, in the market, uses a special tool and rotates the second adjust screw 14 so that the changed R.P.M. may become coincident with the preset one within the minimum allowable limit of 200 R.P.M. On the other hand, this aging change can also be coped with by making such a construction that the throttle valve is shifted in the direction to be closed, as the throttle is operated for a long time period, by suitably designing a compression coil spring 15 and the screwing direction of the second adjust screw 14.

FIG. 2 shows a second embodiment of the present invention, which is characterized in that a stop lever is made to have a dual construction, in that the first adjust screw to be screwed into the stationary bracket of the carburetor is sealed up by means of a cap after it has been adjusted, and in that the second adjust screw can be finely adjusted. More specifically, as shown in FIG. 2, a first adjust screw 18 having a large adjust range is screwed into the stationary bracket 10 of a carburetor 1, and the compression coil spring 13 is interposed between the head of the first adjust screw 18 and the stationary bracket 10. This stationary bracket 10 is made integral with the cylindrical portion 10*a* having such a shape as surrounds the head and adjacent portion of the first adjust screw 18. The opening of the cylindrical portion 10*a* is sealed up with a cap 19 after the adjustment of the first adjust screw 18. On the other hand, this first adjust screw 18 has its leading end abutting against stopper lever 20, which in turn has its lower end portion rotatably mounted on the throttle shaft 6 of a throttle valve 7. It is therefore desired that the stopper lever 20 can swing back and forth in the directions of arrows A—A', but is always biased toward a throttle lever 4 or the first adjust screw 18 in an elastic manner by the action of a non-shown spring.

A second adjust screw 21 for fine adjustment is screwed in the stopper lever 20, and the compression coil spring 15 is sandwiched between the head of the second adjust screw 21 and the stopper lever 20. The leading end of the second adjust screw 21 is in abutment engagement with an abutment portion 4*a* of the throttle lever 4, which in turn is fixed to the throttle shaft 6. By rotating and thus moving the second adjust screw 21 into or out of the stopper lever 20, the stop angle of the throttle lever 4 is regulated, whereby the fine adjustment of the idle R.P.M. of the engine can be effected.

The second adjust screw 21 can, if its forward and backward moving range is completely free, change the idle R.P.M. to an unnecessary value and deteriorate the intrinsic object of the present invention, that is, to make narrower the adjustable range in the market by sealing up the first adjust screw 18. Therefore, limiters 20*a* and 20*b* for limiting the movement of the second adjust screw 21 may be disposed at the sides of the stopper lever 20. Specifically, the limiter 20*b* is provided to prevent the throttle valve 7 from being closed more than a predetermined angle even if the second adjust screw 21 is excessively loosened, whereas the other limiter 20*a* is provided to prevent the throttle valve 7 from being opened more than necessary even if the second adjust screw 21 is excessively closed. It is quite natural that either of the aforementioned limiters can be dispensed with.

If, without the limiters 20*a* and 20*b*, the shape, stroke and so on of the second adjust screw 21 are suitably selected, the idle R.P.M. can be adjusted only within a predetermined range. With the limiters 20*a* and 20*b*, that adjustable range can be further limited.

Figure 3:
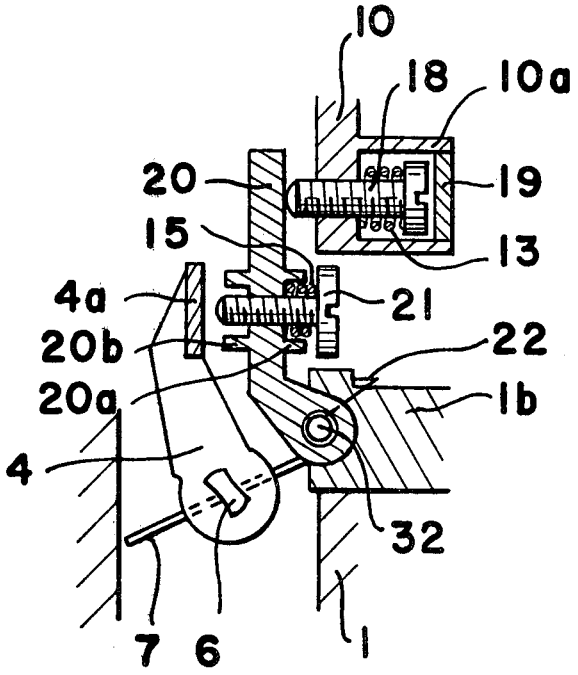
FIG. 3 is a sectional view showing the essential portion of a third embodiment of the present invention.

FIG. 3 shows a third embodiment of the present invention, which is characterized in that the stopper lever 20 of the foregoing second embodiment is rotatably supported on the stationary portion 1*b* of the carburetor 1 by means of a pivot pin 32 and in that the stopper lever 20 is always biased to rotate toward the first adjust screw 18 by the action of a torsion spring 22. The remaining other construction is similar to that of the foregoing second embodiment, and the parts indicated in FIG. 3 at the same reference numerals as those used in FIG. 2 designate those having the same names and performing the same functions.

Figure 4:
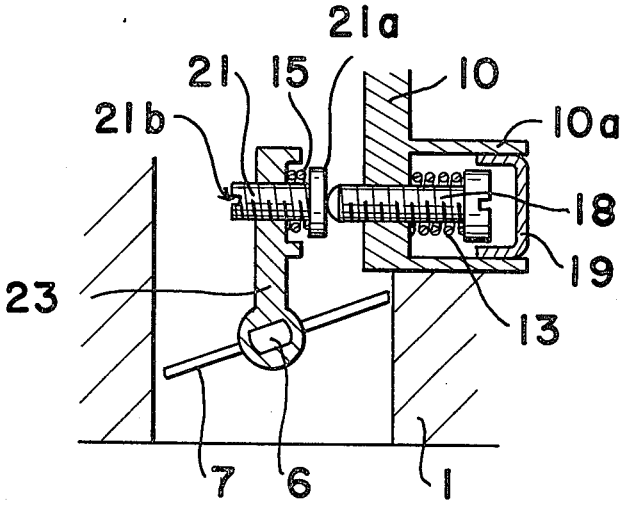
FIG. 4 is a sectional view showing the essential portion of a fourth embodiment of the present invention.

FIG. 4 shows a fourth embodiment of the present invention, which is characterized in that the second adjust screw 21 is screwed into a stopper lever 23 and is formed with an abutment portion 21*a* directly abutting against the leading end of the first adjust screw 18. Reference numeral 21*b* indicates a groove which is formed to allow the tip of a driver or the like to engage with the second adjust screw 21. Since the first adjust screw 18 is sealed up with the cap 19 after it has been adjusted, so that it cannot be readjusted from the outside, the adjustment of the idle R.P.M. is performed by rotating the second adjust screw 21. In FIG. 4, reference numeral 1 indicates the carburetor, 6 being the throttle shaft, 7 being the throttle valve, 10 being the stationary bracket, 10*a* being the cylindrical portion, and 13, 15 being the compression springs.

Figure 5:
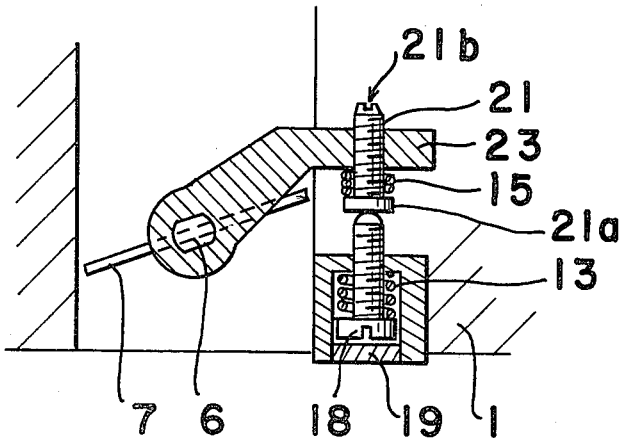
FIG. 5 is a sectional view showing the essential portion of a fifth embodiment of the present invention.

FIG. 5 shows a fifth embodiment of the present invention, which is characterized in that the first adjust screw 18 is mounted in the carburetor 1 by being inserted from below the same while having its leading end abutting against the abutment portion 21*a* of the second adjust screw 21 which in turn is screwed into the stopper lever 23. The remaining other construction is similar to that of the foregoing fourth embodiment, and the parts indicated at the same reference numerals as those used in FIG. 4 designate those having the same names and performing the same functions.

Figure 6A:
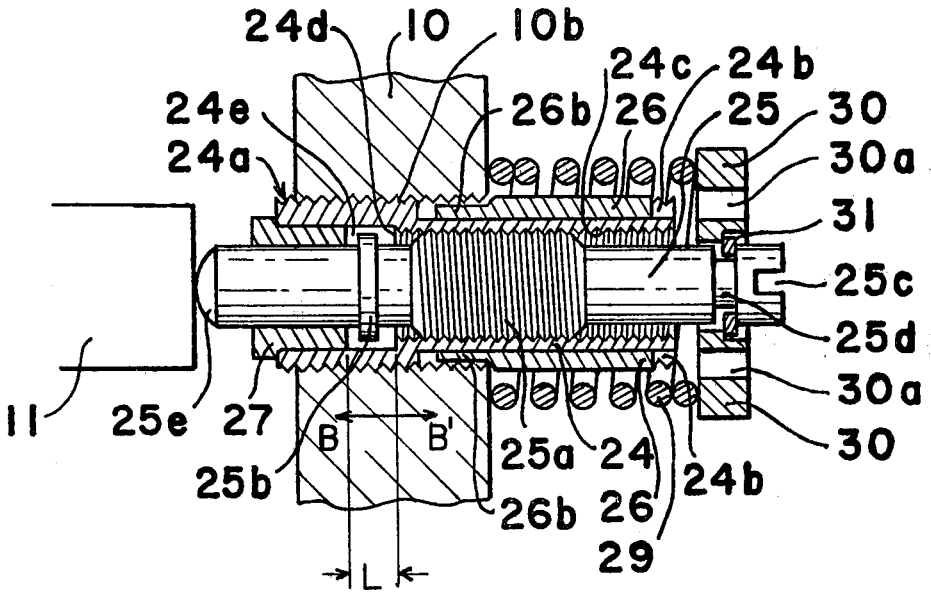
FIG. 6(*a*) is a sectional view showing the essential portion of a sixth embodiment of the present invention.
Figure 6B:
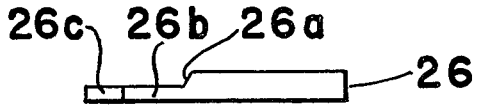
Figure 6C:
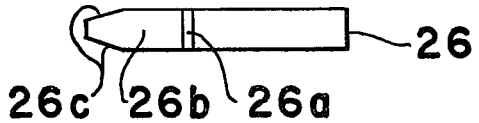

FIG. 6 shows a sixth embodiment of the present embodiment, which is characterized in that a second adjust screw 25 for fine adjustment is screwed in a first adjust screw 24 having a large adjustable range. The sixth embodiment to be described therefore has similar parts to those of the first embodiment shown in FIG. 1. The arrangement of the sixth embodiment facilitates not only an improvement in assembly and adjustment by the manufacturer, but also facilitates the fine adjustment by the user.

The construction of the sixth embodiment will now be described. The first adjust screw 24 is a sleeve formed on its outer circumference with an externally threaded portion 24*a*, which is to be screwed into an internally threaded bore 10*b* formed in the stationary bracket 10 of the carburetor. The first adjust screw 24 is also formed on its outer cirference with two lock key ways 24*b* which extend in the axial direction and which are positioned to correspond to each other. Two lock keys 26 to be fitted in the lock key ways 24*b* are constructed in the form shown in FIGS. 6(*b*) and 6(*c*). The shape of the lock keys 26 will be described later in detail.

The first adjust screw 24 is formed on its inner circumference with an internally threaded portion 24*c*, which has its leading end connecting through a stepped portion 24*d* forming a shoulder with an expanded unthreaded portion 24*e* for receiving a press-fitted bush 27. On the other hand, the second adjust screw 25 has its outer circumference formed substantially midway between its end with an externally threaded portion 25*a*, which is formed to be screwed into the internally threaded portion 24*c* of the first adjust screw 24. The second adjust screw 25 is further formed on its outer circumference with an annular flanged portion 25*b*, which is juxtaposed at a preset spacing to the externally threaded portion 25*a*. Still moreover, the second adjust screw 25 is formed at its righthand end with a screw slot 25*c*, for facilitating adjustment of this screw and at the lefthand side of this driver slot 25*c* with an annular groove 25*d*.

The assembling procedures of the adjust screw device shown in FIG. 6 are performed in the following. First of all, the second adjust screw 25 is inserted into the expanded portion 24*e* of the first adjust screw 24, and the externally threaded portion 25*a* is screwed in the internally threaded portion 24*c*. At the time when the annular flanged portion 25*b* comes in the expanded portion 24*e*, the stopper bush 27 is press-fitted in the expanded portion 24*e* so that the first and second adjust screws 24 and 25 cannot be separated from each other.

The assembly of the first and second adjust screws 24 and 25 thus made is fixed to the stationary bracket 10 of the carburetor by screwing the externally threaded portion 24*a* in the internally threaded bore 10*b*. Since at this time, the lefthand screw end 25*e* of the second adjust screw 25 is in abutment engagement with the abutment portion 11 of the throttle lever, the throttle opening can be adjusted over a wide range by rotating and moving the first adjust screw 24 in the direction of arrow B—B′, as viewed from FIG. 6(*a*). It is quite natural that, when the first adjust screw 24 is moved in the direction B—B′, with respect to the stationary bracket 10, the second adjust screw 25 is moved together in the same direction B—B′.

When the first adjust screw 24 is rotated until the adjustment of the throttle opening is finished, as has been described in the above, the pair of lock keys 26 are pressfitted in the lock key ways 24*b*, so that the first adjust screw 24 is fixed, and further adjustment is blocked. After that, a compression coil spring 29 and a washer 30 are fitted on the righthand protrusion of the first adjust screw 24 such that the washer 30 is retained by means of an E-ring 31 which in turn is fitted in the annular groove 25*d*. Under this particular condition, the compression coil spring 29 is interposed under compression between the stationary bracket 10 and the washer 30. Moreover, since the washer 30 is formed with radially opposed apertures 30*a*, the lock keys 26 can be introduced through the apertures 30*a*.

Here, the shape of the lock keys 26 will be described. As shown in FIGS. 6(*b*) and 6(*c*), each lock key 26 is formed at its leading end through a stepped portion 26*a* with a thinned portion 26*b*, which is formed with tapered sides 26*c*. These tapered sides 26*c* are formed to facilitate insertion of the lock keys 26.

After the first adjust screw 24 has been fixed by means of the lock keys 26, the adjustment of the throttle opening can be performed by rotating and moving the second adjust screw 25 in the direction B—B′. Since, incidentally, the annular flanged portion 25*b* of the second adjust screw 25 has its movable range restricted by the shoulder 24*d* and the stopper bush 27, the second adjust screw 25 is allowed to move only a length L in the direction B—B′. In other words, all that can be performed by the second adjust screw 25 is the final adjustment of the throttle opening.

As has been described hereinbefore, the adjust screw device according to the present invention is so constructed that the opening of the throttle valve of the carburetor is adjusted by means of both the first adjust screw having a larger adjustable range and the second adjust screw for the fine adjustment. As a result, since the first adjust screw cannot be adjusted any more from the outside after it has been preset at an initial opening level, it is possible to prevent completely the alteration and mistaken adjustment of the user of the vehicle. Moreover, since the readjustment within a predetermined range can be performed by means of the second adjust screw in case the opening of the throttle valve is changed due to the aging, it is possible to maintain the exhaust gas cleaning function, the performance of the engine and the fuel economy at excellent levels.

Moreover, since the throttle valve can be biased to rotate in its closed direction as the time elapses by suitably designing the screwing direction of the second adjust screw and the spring applying an elastic force to that screw, it is also possible to automatically prevent the rise in the R.P.M. due to the reduction in the rotational resistance.

Still moreover, since the initial adjustment of the idle R.P.M. by the manufacturer is absolutely the same as that of the prior art, it is further possible to effect that initial adjustment with remarkable ease and to set the R.P.M. adjustable range thereafter only at the plus side, and the minus side and at both the plus and minus sides in accordance with the initial position of the second adjust screw.

What is claimed is:

1. An adjustment screw device for a carburetor for an internal combustion engine, said carburetor having a throttle lever for controlling a throttle valve, and for installation on a stationary member in the vicinity of the throttle lever, the device comprising:

a first adjust screw rotatable with respect to the stationary member over a relatively large range for initially presetting the R.P.M. of the engine;

a second adjust screw for relatively finely adjusting of the R.P.M. of the engine, the leading end of said second adjust screw abutting the throttle lever, said second adjust screw being continuously accessible for adjustment;

means for moving said second adjust screw to and from said throttle lever in accordance with the rotation of said first adjust screw; and means for blocking access to said first adjust screw after said initial presetting.

2. The adjustment screw device of claim 1 also including means for limiting the range of adjustability of said second adjust screw.

3. The device according to claim 2 wherein said means for moving said second adjust screw in accordance with the rotation of said first adjust screw includes a bore in said first adjust screw, said second adjust screw being threadably engaged in said bore, and wherein said limiting means includes a shoulder in said bore for limiting the depth of insertion of said second adjust screw into said bore and an annular stop bush around said second adjust screw and press-fitted into said bore for limiting the rotatable adjustment of said second adjust screw outwardly from said bore.

4. The device according to claim 3 also including means near the leading end of said second adjust screw for facilitating the rotatable adjustment of said second adjust screw.

5. The device according to claim 3 wherein said first screw device is a sleeve threaded into said stationary member, the end of said second adjust screw opposite said leading end extends outwardly through said sleeve and includes means for facilitating the rotatable adjustment of said second adjust screw.

6. The device according to claim 5, wherein said blocking means includes key means for preventing rotation of said sleeve with respect to said stationary member.

7. The device according to claim 6 wherein said key means includes at least one keyway in the threaded outer surface of said sleeve and a complementary locking key for press-fitting into said keyway.

8. The device according to claim 7 wherein said key means includes a pair of radially opposed keyways and a pair of locking keys for press-fitting into said keyways.

9. The device according to claim 6 also including a washer having a plurality of apertures therein mounted on said outwardly extending end of said second adjust screw, means for retaining said washer on said outwardly extending end and a compressed spring captured between said washer and said stationary member, and wherein said key means includes at least one keyway in the threaded outer surface of said sleeve and a complementary locking key for insertion through one of said apertures into said keyway.

10. The device according to claim 9 wherein said device includes a pair of keyways on opposite sides of said sleeve and radially opposed apertures in said washer for receiving locking keys for each of said pair of keyways.

11. The device according to any one of claims 7, 8, 9, and 10, wherein each of said locking keys includes an elongated body portion of greater depth than the depth of said keyway and a leading end portion of lesser depth than said body portion for inserting in the keyway extending into said stationary member, the leading end portion of said key having a spade formation for facilitating insertion of said key into said keyway.

12. The device according to claim 2 wherein said means for moving said second adjust screw in accordance with the rotation of said first adjust screw includes a stopper lever rotatably mounted with respect to said throttle lever, the leading end of said first adjust screw abutting said stopper lever and wherein said second adjust screw is threaded through and carried by said stopper lever.

13. The device according to claim 12 wherein said means for limiting the adjustability of said second adjust screw includes means for limiting the depth of insertion of said second adjust screw through said stopper lever.

14. The device according to claim 12 wherein said means for limiting the adjustability of said second adjust screw includes means for predetermining the minimum distance between said stopper lever and said abutment portion of said throttle lever.

15. The device according to claim 12, 13, or 14 wherein said stopper lever is rotatably mounted on the shaft of the throttle valve.

16. The device according to claim 12, 13, or 14 wherein said stopper lever is rotatably mounted on a stationary part of the carburetor, and said device includes a torsion spring for biasing said stopper lever toward the leading end of said first adjust screw.

17. An adjustment screw device for a carburetor having a throttle valve comprising:

lever means for positioning said throttle valve;

a fine adjust screw acting directly on said lever means, said fine adjust screw being continuously accessible for adjustment;

an initial adjust screw rotatable over a relatively large range with respect to a fixed position for initially presetting the R.P.M. of the engine, said initial adjust screw acting indirectly on said lever means through said fine adjust screw;

means for blocking access to said initial adjust screw after said initial presetting.

18. The device according to claim 17 wherein said lever means includes a lever arm fixedly connected to said throttle valve, said fine adjust screw has a leading end threaded through said lever arm and said initial adjust screw is substantially axially aligned with said fine adjust screw, the leading end of said initial adjust screw abutting the end of said fine adjust screw opposite its leading end.

19. The device according to claim 17 or 18 also including means on the leading end of said fine adjust screw for facilitating the adjustment of the fine adjacent screw.

20. The device according to claim 19 wherein said throttle valve is mounted in a columnar channel and wherein said axially aligned screws extend into said channel above said throttle valve.

21. The device according to claim 19 wherein said throttle valve is mounted in a columnar channel, said lever arm has an elongated portion extending outside said channel, said axially aligned screws extend parallel to the wall of said columnar channel, and the end of said initial adjust screw extends below the level of said throttle valve.

22. The adjustment screw device of claim 17 also including means for limiting the range of adjustability of said fine adjust screw.

23. The adjustment screw device of claim 22 also including a stop lever rotatably mounted for movement toward and away from said lever means, and wherein said fine adjust screw is threaded through said stop lever and movable therewith, and wherein the leading end of said initial adjust screw acts on said stop lever.

24. The adjustment screw device of claim 23 wherein said throttle valve is mounted on a throttle shaft and wherein said lever means is fixed to said throttle shaft and said stop lever is rotatably mounted on said throttle shaft.

25. The adjustment screw device of claim 23 wherein said stop lever is rotatably mounted on a wall of said carburetor, and wherein said device also includes means for biasing said stop lever toward said leading end of said initial adjust screw.

26. An adjustment screw device for a carburetor of an internal combustion engine, said carburetor having a throttle valve and the device being for installation in a fixed member of the engine or carburetor, said device comprising:

a lever member for positioning said throttle valve;

a sleeve having a threaded outer surface for adjustably engaging a threaded through bore in said fixed member;

a substantially cylindrical fine adjust screw having a threaded portion substantially centrally located between its end for insertion into said sleeve, the leading end of said adjust screw engaging an abutment surface of said lever member and said threaded portion engaging a threaded inner surface portion of said sleeve;

an enlarged unthreaded bore portion of the inner surface of said sleeve forming a shoulder in said sleeve;

an annular member on the surface of said cylindrical adjust screw for engagement with said shoulder and limiting the movement of said fine adjust screw outwardly away from said lever member;

an annular stop bush press-fitted into said bore portion of said sleeve around said fine adjust screw for determining the limit of the inward movement of said fine adjust screw toward said lever member;

at least one keyway in the threaded outer surface of said sleeve, said keyway extending into the area of the bore in said fixed member;

a locking key for insertion into said keyway after the rotational adjustment of said sleeve relative to said fixed member for presetting the initial R.P.M. of said member, said locking key preventing further rotation of said sleeve with respect to said fixed member;

a washer positioned on the outer end of said fine adjust screw;

means for retaining said washer on said fine adjust screw; and a compression spring mounted around said fine adjust screw and captured between said fixed member and said washer.

* * * * *